US010677126B2

(12) United States Patent
Schlipf

(10) Patent No.: US 10,677,126 B2
(45) Date of Patent: Jun. 9, 2020

(54) ELECTRICALLY HEATABLE CATALYTIC CONVERTER AND METHOD FOR MANUFACTURING SAME

(71) Applicant: TÜRK & HILLINGER GMBH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 116 days.

(21) Appl. No.: 15/207,864

(22) Filed: Jul. 12, 2016

(65) Prior Publication Data

US 2017/0016370 A1 Jan. 19, 2017

(30) Foreign Application Priority Data

Jul. 17, 2015 (DE) ..... 10 2015 111 689

(51) Int. Cl.
*F01N 3/20* (2006.01)
*H05B 3/48* (2006.01)

(52) U.S. Cl.
CPC ..... *F01N 3/2013* (2013.01); *H05B 3/48* (2013.01)

(58) Field of Classification Search
CPC ..... F01N 3/2013; H05B 3/48
See application file for complete search history.

(56) References Cited

U.S. PATENT DOCUMENTS 2,905,919 A * 9/1959 Lorch ..... H05B 3/56 338/224
3,768,982 A * 10/1973 Kitzner ..... B01J 35/02 392/473
4,523,935 A * 6/1985 Takagi ..... B01D 39/2093 219/205
5,140,812 A * 8/1992 Cornelison ..... F01N 3/2026 392/375
5,149,508 A 9/1992 Bullock
5,456,890 A * 10/1995 Tsai ..... F01N 3/2013 422/174
5,494,642 A * 2/1996 Sanada ..... F01N 3/2026 219/552

(Continued)

FOREIGN PATENT DOCUMENTS

CN 2 516 702 Y 10/2002
DE 195 20 758 A1 12/1996

(Continued)

*Primary Examiner* — Matthew T Largi
(74) *Attorney, Agent, or Firm* — McGlew and Tuttle, P.C.

(57) ABSTRACT

An electrically heatable catalytic converter (100, 200, 300, 400) for treating a gas stream, especially of the exhaust gas stream of an internal combustion engine, the electrically heatable catalytic converter (100, 200, 300, 400) has a tubular housing (101, 201, 301, 401), an interior space enclosed by the tubular housing (101, 201, 301, 401), and a porous structure, which is arranged in the interior space of the tubular housing (101, 201, 301, 401) and can be heated by an electric heater, in which the electric heater is a mineral-insulated heater (103, 203, 303, 403) with a heat conductor (104, 204, 304, 404), with at least one front-side connection opening (109, 209, 210, 309, 409) and with at least one outer metal jacket (108, 208, 308, 408), the mineral-insulated heater (103, 203, 303, 403) has at least one section (103, 203*a*, 203*b*, 303*a*), which is passed through a housing wall.

8 Claims, 5 Drawing Sheets

(56) References Cited

U.S. PATENT DOCUMENTS

| | | | | | |
|---|---|---|---|---|---|
| 5,536,478 | A * | 7/1996 | Lipp | F01N 3/2026 | 422/174 |
| 5,695,722 | A * | 12/1997 | Myers | F01N 3/2013 | 219/536 |
| 5,887,427 | A * | 3/1999 | Maus | F01N 3/2026 | 219/541 |
| 5,904,903 | A | 5/1999 | Hotz et al. | | |
| 6,562,305 | B1 * | 5/2003 | Swars | B32B 15/04 | 422/174 |
| 9,623,373 | B2 * | 4/2017 | Brueck | F01N 3/2026 | |
| 2003/0017086 | A1 * | 1/2003 | Bruck | F01N 3/2006 | 422/168 |
| 2010/0133251 | A1 | 6/2010 | Konieczny et al. | | |
| 2014/0190151 | A1 | 7/2014 | Culbertson et al. | | |

FOREIGN PATENT DOCUMENTS

| | | | | |
|---|---|---|---|---|
| DE | 10 2007 024 563 | A1 | | 11/2008 |
| EP | 0 485 179 | A2 | | 5/1992 |
| EP | 0 638 710 | A2 | | 2/1995 |
| EP | 0 677 649 | A1 | | 10/1995 |
| JP | 58-023187 | A | | 2/1983 |
| JP | H05-59939 | | * | 3/1993 |
| JP | H05-059939 | A | | 3/1993 |
| JP | H07-289914 | A | | 11/1995 |
| JP | H10-507337 | A | | 7/1998 |
| JP | 2002-235530 | A | | 8/2002 |
| JP | 2009-248946 | A | | 10/2009 |
| WO | 92/13 636 | A1 | | 8/1992 |
| WO | 96/11329 | A1 | | 4/1996 |

* cited by examiner

ELECTRICALLY HEATABLE CATALYTIC CONVERTER AND METHOD FOR MANUFACTURING SAME

CROSS REFERENCE TO RELATED APPLICATIONS

This application claims the benefit of priority under 35 U.S.C. § 119 of German patent application 10 2015 111 689.8 filed Jul. 17, 2015, the entire contents of which are incorporated herein by reference.

FIELD OF THE INVENTION

The present invention relates to an electrically heatable catalytic converter as well as to a method for manufacturing same.

BACKGROUND OF THE INVENTION

Catalytic converters for the treatment of a gas stream are generally known, especially in connection with exhaust gas treatment for internal combustion engines of motor vehicles. They may contain a number of components, especially three-way catalytic converters, hydrocarbon adsorbers and a porous structure, which may be embodied especially as a mesh, as a screen or as a honeycomb body. Such systems are known, for example, from EP 0 638 710 A2 and EP 0 485 179 A2.

A special problem of such catalytic converters is that they shall function already in the cold start phase. To ensure this, it is known, for example, from DE 10 2007 024 563 A1 that catalytic converters can be equipped with an electrically heatable honeycomb body, which is used to heat the exhaust gas.

Heated porous structures known from the state of the art operate according to the principle that the heating effect is achieved through a flow of current through at least some of the wires, plates or plate stacks, which together form the porous structure. Since a uniform heating effect is desirable, it is necessary to apply current to a plurality of wires, plates or plate stacks and to ensure, on the one hand, that the current paths thus formed have a resistance that is defined as a fixed resistance that is especially identical to the extent possible and, on the other hand, to ensure an electrical insulation between the wires, plates or plate stacks. In particular, an electrically insulated suspension of the wires, plates or plate stacks is necessary for this. All these insulations hinder the flow of exhaust gas. As a result, all this leads to a complicated and expensive manufacturing process, which also leads, moreover, to a heatable catalytic converter that is sensitive to vibrations and has a considerable risk of failure.

SUMMARY OF THE INVENTION

The object of the present invention is therefore to provide an electrically heatable catalytic converter that is cost-effective, can be manufactured in a simple manner and is robust and a method for manufacturing same.

This object is accomplished by an electrically heatable catalytic converter of the present invention and by a method for manufacturing same.

The electrically heatable catalytic converter according to the present invention for the treatment of a gas stream, especially of the exhaust gas stream of an internal combustion engine, has a tubular housing, an interior space enclosed by the tubular housing and a porous structure, which is arranged in the interior space of the tubular housing, can be heated by means of an electric heater and may be embodied especially as a mesh, as a screen or as a honeycomb body.

It is essential for the present invention that the electric heater is a mineral-insulated heater with a heat conductor, at least one front-side connection opening and with at least one outer metal jacket, wherein the mineral-insulated heater has at least one section that is passed through a housing wall, so that all front-side connection openings are arranged outside the interior space of the tubular housing and the outer metal jacket of the mineral-insulated heater is welded or soldered in this section to the tubular housing directly or via a mineral-insulated, vacuum-tight duct, and wherein the heat conductor is fully embedded, at least in the sections of the mineral-insulated heat conductor that are arranged in the interior space of the gas duct, in an insulation, which is preferably compacted. The material suitable for the insulation is especially a ceramic material.

It is ensured by the use of a mineral-insulated heater with an outer metal jacket with a front-side connection opening that is arranged outside the housing that the desired electrical insulation is ensured, while the outer metal jacket and its welding or soldering to the housing at the same time ensures a dimensionally stable and vibration-resistant arrangement of the electric heater.

Uniform heating of the porous structure and especially of a mesh, screen or honeycomb body can be achieved by at least one section of the mineral-insulated heater being rolled into the porous structure. This is achieved especially if the mineral-insulated heater is helical, for example, in the form of a coil spring with concentric windings with different radii.

A further improvement of the vibration stability can be achieved if the mineral-insulated heater is soldered, especially vacuum-soldered to the porous structure.

A special advantage of the use of a mineral-insulated heater with metal jacket is that the cross-sectional shape of the mineral-insulated heater can be modeled as desired. In particular, the gas stream in the sections of the catalytic converter, in which the mineral-insulated heater is arranged, can thus be influenced by adapting this shape and, further, homogenization of heating can be achieved by adapting the shape.

It proved to be especially advantageous if the mineral-insulated heater has a smaller cross section in the direction of flow of the gas than in the walls of the porous structure, especially in the direction the walls of the honeycombs of a honeycomb body and if the extension of the mineral-insulated heater—it should be noted that the extension is defined here as the geometric extension to avoid misinterpretation, although it would be unlikely—is at least four times and preferably at least 10 times greater than the extension in the direction facing the walls of the porous structure, especially walls of the honeycombs of a honeycomb body.

Also conceivable is an embodiment in which the heating element of the mineral-insulated heater is connected at one end to the tubular housing, so that the tubular housing acts as a return conductor. This reduces the effort needed for cabling.

It is especially advantageous if the tubular housing consists of an Inconel alloy material with a nickel content of at least 25% and preferably at least 50%.

Depending on the desired heat distribution, a plurality of mineral-insulated heaters may be arranged in the openings of the porous structure, especially in the openings of a honeycomb structure.

The method according to the present invention for manufacturing an electrically heatable catalytic converter has the following steps:

provision of a flat, porous structure, which may be embodied especially as a mesh, as a screen or as a honeycomb structure, with a mineral-insulated heater, which is in contact with the porous structure and has a heat conductor, at least one front-side connection opening and at least one outer metal jacket and is arranged on the porous structure such that the at least one front-side connection opening projects over the porous structure, rolling up of the flat, porous structure with the mineral-insulated heater being in contact with it, soldering of the rolled-up porous structure obtained by the rolling up with the outer metal jacket of the heater, which is rolled up in same by the rolling up, wherein the soldering is preferably carried out under vacuum, insertion of the rolled-up porous structure with the mineral-insulated heater rolled up in it into a housing, so that the at least one connection opening projecting over the porous structure projects from the interior space of the housing through a duct opening in the housing wall, and welding or soldering of the outer metal jacket of the mineral-insulated heater in the mineral-insulated, vacuum-tight duct in to the tubular housing directly or via a mineral-insulated, vacuum-tight duct, so that the duct opening is closed in a vacuum-tight manner.

The great advantage of this method is that it can be carried out in a simple and cost-effective manner.

The method steps may be carried out in the manner described, but it is explicitly noted that it would also be possible to carry out especially the soldering of the rolled-up porous structure after one of the steps.

In particular, it is also possible that the mineral-insulated heater is provided with welded connection openings and the connection openings are uncovered only after the step of soldering, especially vacuum soldering.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Identical reference numbers are used for identical components of the same embodiment, which are shown in different figures.

Figure 1:
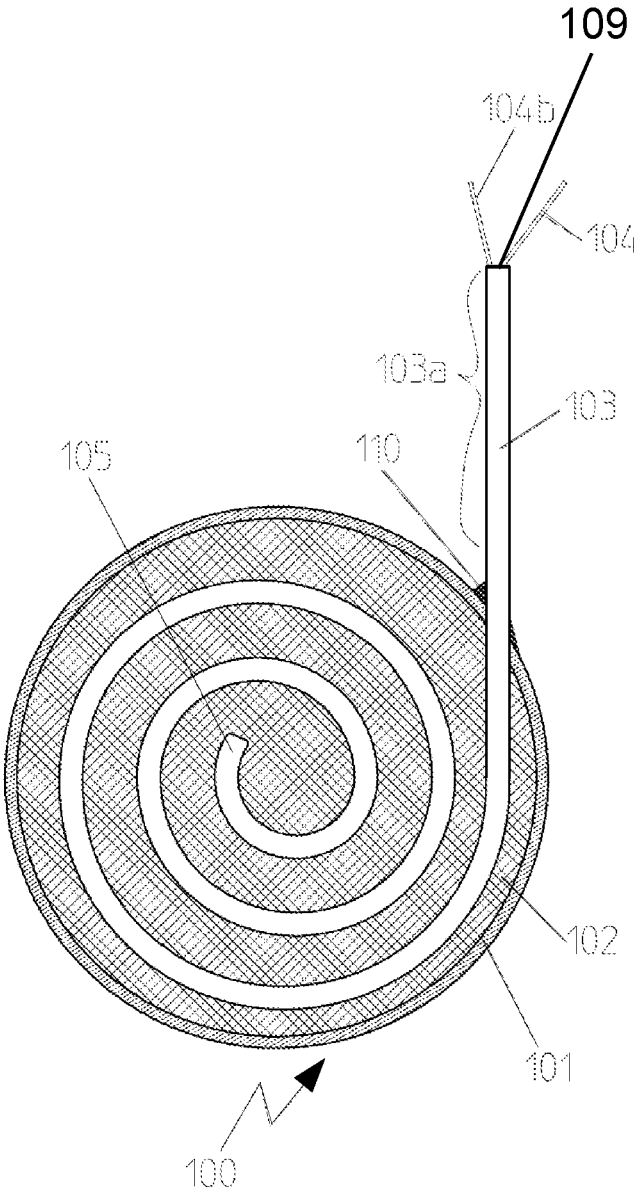
FIG. 1 is a cross sectional view through a first embodiment of an electrically heatable catalytic converter.

FIG. 1 shows a cross section through a first embodiment of an electrically heatable catalytic converter 100. The electrically heatable catalytic converter 100 has a tubular housing 101. A porous structure 102, designed as a honeycomb body in this exemplary embodiment, which is heatable by means of an electric heater, which is helically embedded in the porous structure 102 configured as a honeycomb body, is arranged in the interior space enclosed by the housing 101.

Figure 2:
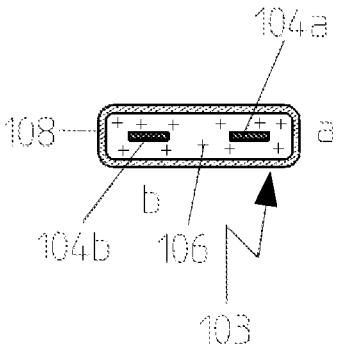
FIG. 2 is a cross sectional view through the mineral-insulated heater according to the embodiment shown in FIG. 1 at right angles to the direction in which the mineral-insulated heater extends.

As can be best seen in the cross-sectional view shown in FIG. 2, the electric heater is a mineral-insulated heater 103 with a heat conductor 104, which has a first section 104*a* and a section 104*b*, which extends in parallel thereto in the opposite direction, said heat conductors being connected to one another in the area of the tip 105 of the mineral-insulated heater 103, which tip is shown in FIG. 1. The heat conductor 104 is embedded in a compacted insulation 106, which is embedded fully, i.e., in all directions that are at right angles to an extension direction, in the compacted insulation 106, which may consist of, e.g., MgO. Further, the mineral-insulated heater 103 has an outer metal jacket 108.

The mineral-insulated heater 103 shown in FIG. 2 has a smaller cross section in the direction in which the gas flows, i.e., viewed from the side of the outer metal jacket 108, which side is marked by the letter a, than when viewed in the direction facing the walls having a porous structure 102, i.e., in the direction facing the walls of the honeycombs of the honeycomb body in the embodiment of the porous structure 102 which is being shown here, i.e., viewed from the side of the outer metal jacket 108, which side is marked by the letter b.

Further, in the direction in which the gas flows, i.e., along the side of the metal jacket 108 marked by the letter b, the extension of the mineral-insulated heater 103 is more than four times the extension in the direction facing the walls having a porous structure 102, i.e., in the direction facing the walls of the honeycombs of the honeycomb body 102, which corresponds to the direction marked by the letter a.

As is seen in FIG. 1, the mineral-insulated heater 103 has, further, a front-side connection opening 109, which is located at a section 103*a* of the mineral-insulated heater 103, which section is passed through the wall of the tubular housing 101, so that it is outside the interior space of the tubular housing. The outer metal jacket 108 of the mineral-insulated heater 103 is tightly connected with a soldered joint 110 in this section, more precisely, at the point at which it passes through the tubular housing.

Figure 3:
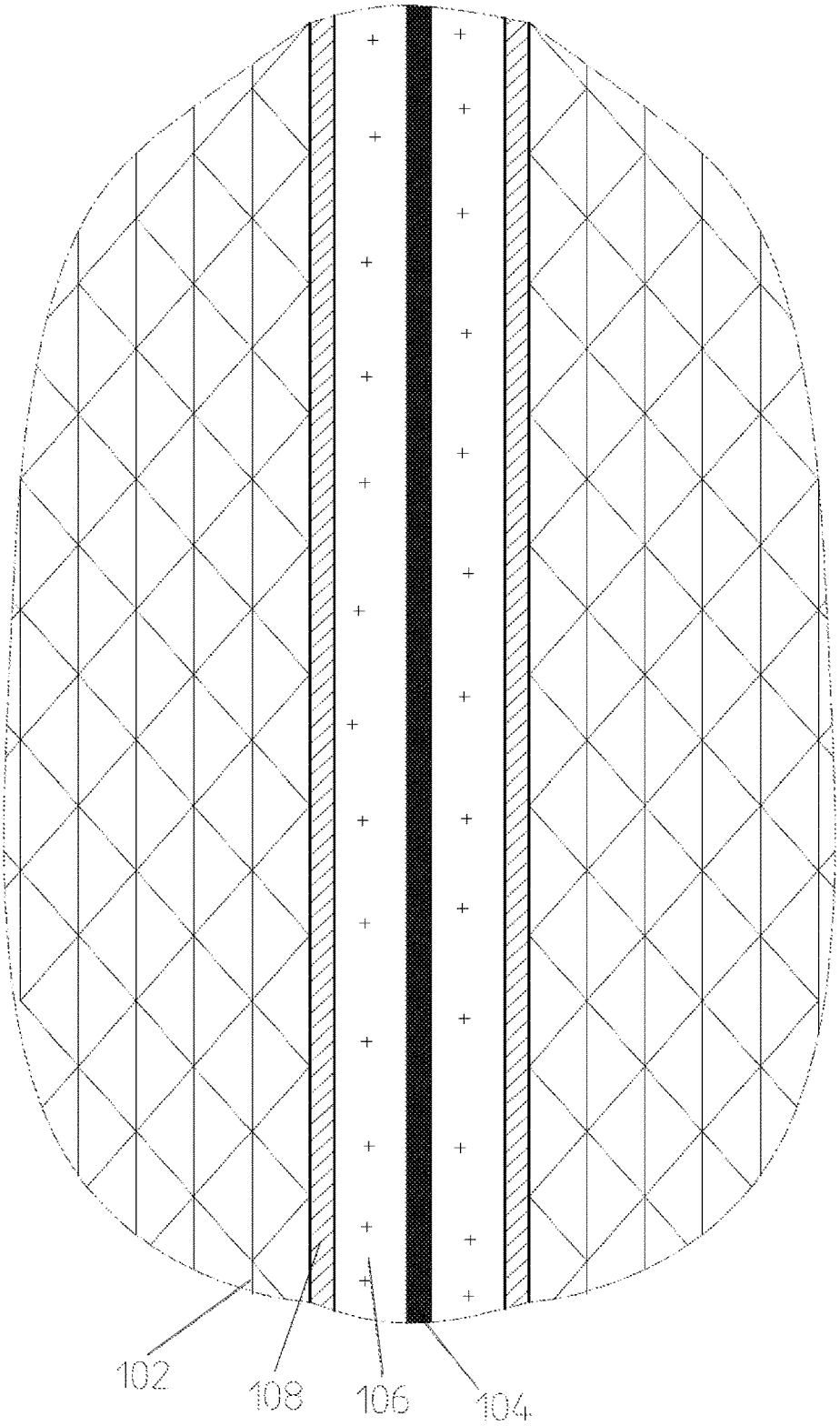
FIG. 3 is an enlarged detail view of a cross section through the embodiment according to FIG. 1, cut in a plane in which the heating element of the mineral-insulated heater is located.

The enlarged detail of a cross section according to FIG. 3 through the embodiment according to FIG. 1, cut in a plane in which the heat conductor 104 of the mineral-insulated heater 103 is located, illustrates once again that the current-carrying heat conductor 104 is electrically insulated by the compacted insulation 106 from the outer metal jacket 108 and that the heat generated by the heat conductor 104 is released via the insulation 106 and the outer metal jacket 108 to the wall structure of the porous structure 102, i.e., to the honeycomb structure of the honeycomb body in the embodiment being shown.

Figure 4:
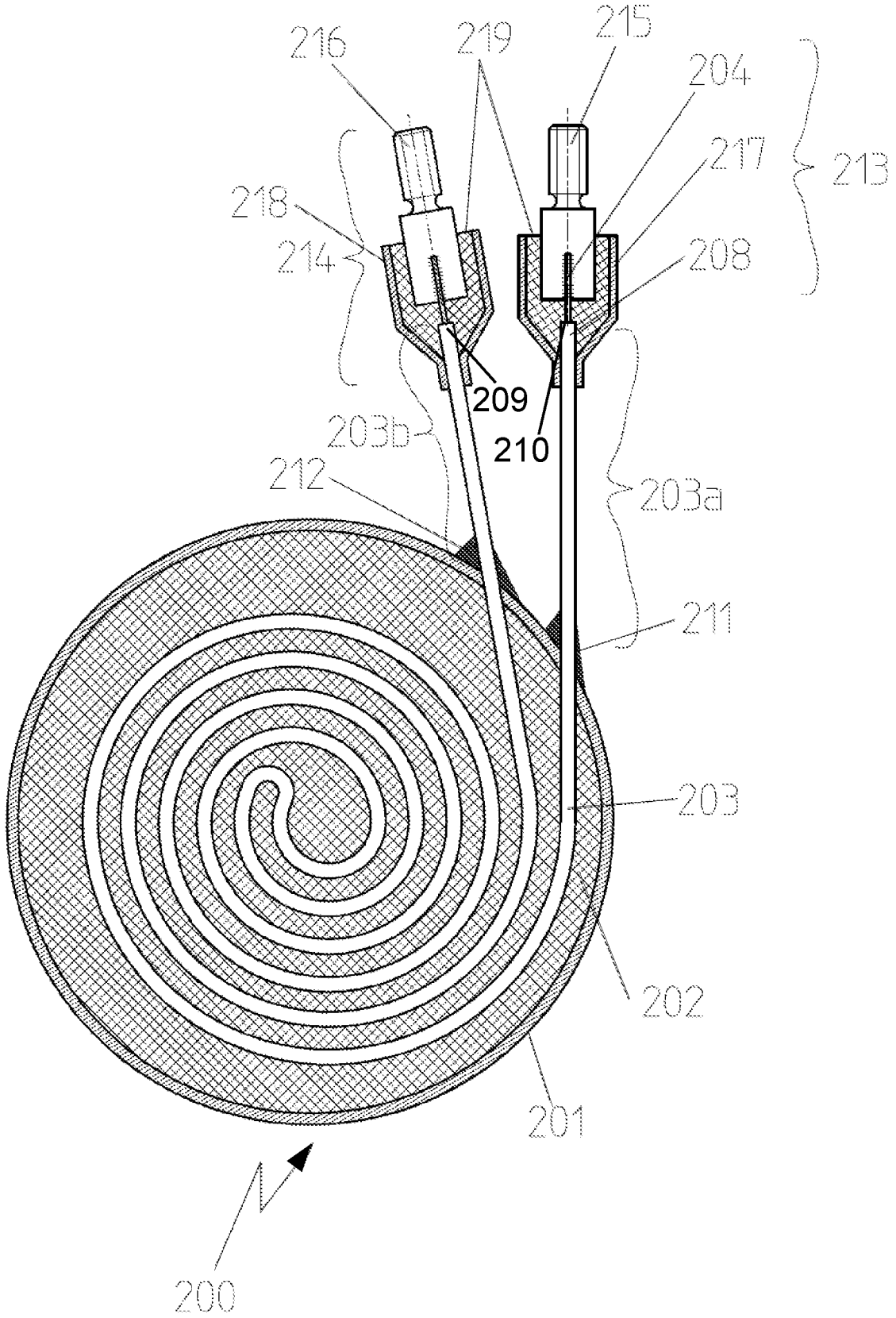
FIG. 4 is a cross sectional view through a second embodiment of an electrically heatable catalytic converter.

The embodiment of a heatable catalytic converter 200 shown in FIG. 4 differs from the embodiment according to FIGS. 1 through 3 only in respect to the configuration of the mineral-insulated heater 203. This contains a strip-shaped heat conductor 204 embedded in a compacted MgO filling, not shown, with an outer metal jacket 208, which has two front-side connection openings 209, 210, which are located at two sections 203*a*, 203*b* of the mineral-insulated heater 203, which are passed through the tubular housing 201, so that they are located outside the interior space of the tubular housing 201. The outer metal jacket 208 of the mineral-insulated heater 203 is tightly connected by soldered joints 211, 212 in these sections, more precisely, at the respective points at which they pass through the tubular housing 201.

Further, connector plugs 213, 214 are also provided for supplying the heat conductor 204 with current in FIG. 4. The connector plugs 213, 214 have contact bushes 215, 216, which are plugged onto the strip-shaped heat conductor 204 and are fixed and electrically insulated by casting with an electrically non-conductive casting compound 219 received in plug housings 217, 218 fastened on the outer metal jacket 208.

Figure 5:
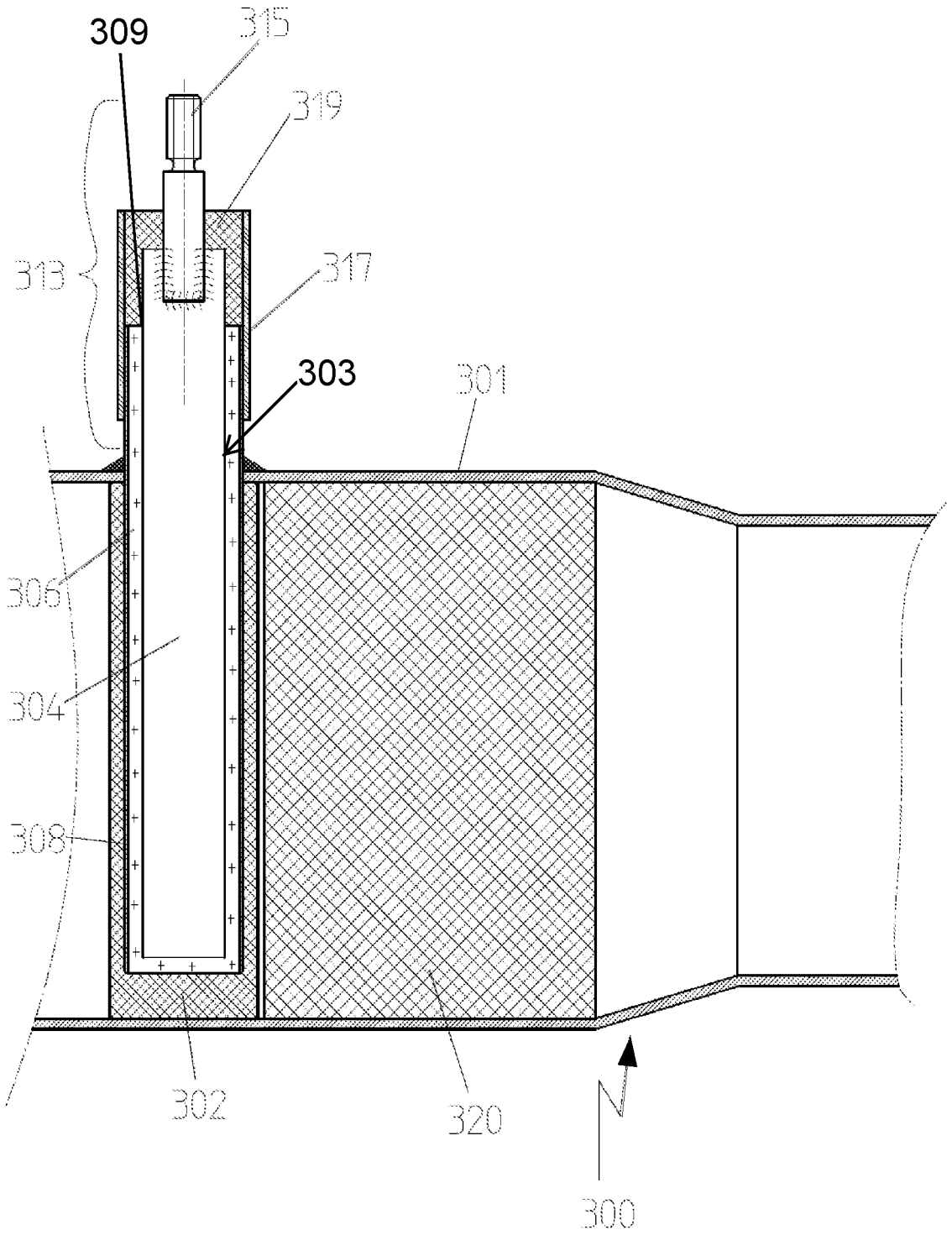
FIG. 5 is a cross sectional view through a third embodiment of an electrically heatable catalytic converter.

FIG. 5 shows a cross section along a curved section surface through a third embodiment of a heatable catalytic converter 300 with a tubular housing 301, in which a first porous structure 302, which is configured as a first honeycomb body in this example and can be heated with a mineral-insulated heater 303, which has a configuration identical to that shown in FIG. 4, and a second porous structure 320, which is configured as a second honeycomb body in this example, are embedded. It shall be illustrated with this exemplary embodiment, in particular, that an electrically heatable catalytic converter 300 is already present in the sense of the present invention if a partial area of the catalytic converter 300 is heatable.

Figure 6:
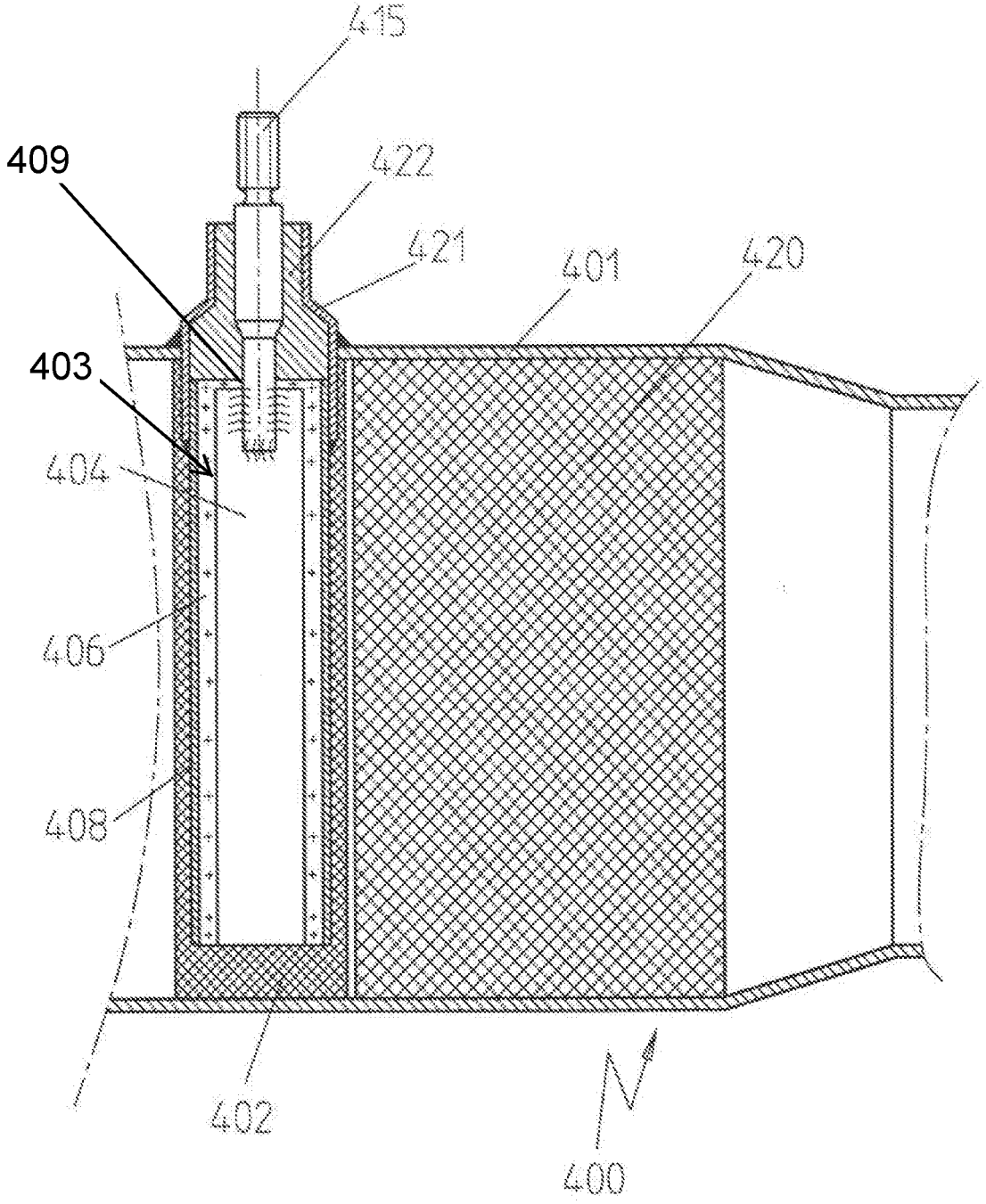
FIG. 6 is a cross sectional view through a fourth embodiment of an electrically heatable catalytic converter.

The embodiment of the heatable catalytic converter 400 shown in FIG. 6 shows, like the embodiment according to FIG. 5, a tubular housing 401 with a first porous structure 402, which is configured as a honeycomb body in this exemplary embodiment, and with a second porous structure 420, which is configured as a honeycomb body in this exemplary embodiment, wherein the first porous structure 402 can be heated by a mineral-insulated heater 403. The essential difference between the two embodiments is that the heat conductor 404 of the mineral-insulated heater 403 is connected at one end to the metal jacket 408, so that current is sent through the first porous structure 402 to the tubular housing 401, which acts as a return conductor.

Another difference is that the contact to the tubular housing 401 is formed here via a duct 421, which is placed on the metal jacket 401 and is filled with a mineral insulation 422.

While specific embodiments of the invention have been shown and described in detail to illustrate the application of the principles of the invention, it will be understood that the invention may be embodied otherwise without departing from such principles.

LIST OF REFERENCE NUMBERS

100, 200, 300, 400 Electrically heatable catalytic converter
101, 201, 301, 401 Housing
102, 202, 302, 320, 402, 420 Porous structure
103, 203, 303, 403 Mineral-insulated heater
103*a*, 203*a*, 203*b*, 303*a*, 403*a* Sections of the mineral-insulated heater
104, 204, 304, 404 Heat conductor
104*a* First section of the heat conductor
104*b* Second section of the heat conductor
105 Tip of heat conductor
106, 206, 306, 406 Insulation
108, 208, 308, 408 Metal jacket
109, 209, 210, 309, 409 Front-side connection opening
110, 211, 212, 311 Soldered joint
213, 214, 313 Connector plug
215, 216, 315, 415 Contact bush
217, 218, 317 Plug housing
219, 319 Casting compound
421 Duct
422 Mineral insulation
a, b Sides of the outer metal jacket

What is claimed is:

1. A method for manufacturing an electrically heatable catalytic converter, the method comprising the steps of:

providing a flat, porous structure with a mineral-insulated heater;

arranging at least a portion of said mineral-insulated heater on said flat, porous structure, said portion of said mineral-insulated heater being in contact with said flat, porous structure, said mineral-insulated heater having at least one front-side connection opening and at least one outer metal jacket and said mineral-insulated heater being arranged on said flat, porous structure such that said at least one front-side connection opening projects over a flat honeycomb structure;

rolling up of said flat, porous structure with said mineral-insulated heater after arranging said portion of said mineral-insulted heater on said flat, porous structure to provide a rolled-up structure;

soldering said rolled-up porous structure with said at least one outer metal jacket of said mineral-insulated heater;

inserting said rolled-up structure into a tubular housing, such that said at least one front-side connection opening projecting over said porous structure projects from said interior space of said tubular housing through a duct opening in a housing wall; and welding or soldering of said at least one outer metal jacket of said mineral-insulated heater to said tubular housing directly or via a mineral-insulated, vacuum-tight duct, such that said duct opening is closed in a vacuum-tight manner.

2. The method in accordance with claim 1, wherein said soldering is carried out under vacuum.

3. The method in accordance with claim 1, wherein said mineral-insulated heater comprises a heat conductor, at least a portion of said heat conductor being helically arranged in a compacted insulation in said interior space of said housing, said at least one outer metal jacket comprising at least one section located outside of said interior space, said at least one section comprising an outer metal jacket portion, said outer metal jacket portion being connected to said tubular housing via a soldered or welded connection, said soldered or welded connection being located outside of said interior space.

4. The method in accordance with claim 1, wherein said mineral-insulated heater has a smaller cross section in a direction in which a gas flows than in a direction facing walls of said flat, porous structure.

5. The method in accordance with claim 4, wherein in said direction in which said gas flows, an extension of said mineral-insulated heater has a dimension that is at least four times larger than a dimension of an extension in said direction facing walls of said porous structure.

6. The method in accordance with claim 3, wherein said heat conductor of said mineral-insulated heater is connected at one end to said tubular housing in an electrically conducting manner, so that said tubular housing acts as a return conductor, said heat conductor comprising a plurality of helical portions, wherein a portion of said porous structure is arranged between one of said plurality of helical portions and another one of said plurality of helical portions.

7. The method in accordance with claim 1, wherein said tubular housing comprises an Inconel alloy material with a nickel content of at least 25%.

8. The method in accordance with claim 3, wherein a plurality of mineral-insulated heaters are arranged in said flat, porous structure, said compacted insulation being a ceramic insulation.

* * * * *